US009255666B2

(12) United States Patent
Yao et al.

(10) Patent No.: US 9,255,666 B2
(45) Date of Patent: Feb. 9, 2016

(54) ILLUMINATION APPARATUS

(71) Applicant: EPISTAR CORPORATION, Hsinchu (TW)

(72) Inventors: Chiu-Lin Yao, Hsinchu (TW); Been-Yu Liaw, Hsinchu (TW); Chih-Ming Wang, Hsinchu (TW); Ming-Chi Hsu, Hsinchu (TW); Yi-Jui Huang, Hsinchu (TW); Tsung-Xian Lee, Hsinchu (TW); Kuang-Ping Chao, Hsinchu (TW); Jhih-Sian Wang, Hsinchu (TW); Min-hsun Hsieh, Hsinchu (TW); Chien-Liang Liu, Hsinchu (TW)

(73) Assignee: EPISTAR CORPORATION, Hsinchu (TW)

( * ) Notice: Subject to any disclaimer, the term of this patent is extended or adjusted under 35 U.S.C. 154(b) by 195 days.

(21) Appl. No.: 13/631,510

(22) Filed: Sep. 28, 2012

(65) Prior Publication Data

US 2013/0120999 A1 May 16, 2013

Related U.S. Application Data

(63) Continuation-in-part of application No. 13/293,427, filed on Nov. 10, 2011.

(51) Int. Cl.

| | |
|---|---|
| ***F21V 9/16*** | (2006.01) |
| ***F21K 99/00*** | (2010.01) |
| ***F21V 3/04*** | (2006.01) |
| *F21Y 101/02* | (2006.01) |

(52) U.S. Cl.

CPC . *F21K 9/135* (2013.01); *F21K 9/50* (2013.01); *F21K 9/56* (2013.01); *F21V 3/049* (2013.01); *F21V 3/0436* (2013.01); *F21K 9/52* (2013.01); *F21Y 2101/02* (2013.01)

(58) Field of Classification Search

CPC ..... F21V 3/00; F21V 3/0463; F21K 9/10; F21K 9/56; F21Y 2101/02

USPC ..... 362/249.02, 363, 308, 310, 329, 294, 362/327, 268, 331, 84

See application file for complete search history.

(56) References Cited

U.S. PATENT DOCUMENTS

| | | | | |
|---|---|---|---|---|
| 7,588,351 | B2 * | 9/2009 | Meyer | 362/294 |
| 8,212,469 | B2 * | 7/2012 | Rains et al. | 313/503 |
| 8,282,249 | B2 * | 10/2012 | Liang et al. | 362/311.02 |
| 8,562,161 | B2 * | 10/2013 | Tong et al. | 362/84 |
| 8,641,238 | B2 * | 2/2014 | Chiu et al. | 362/335 |
| 2011/0216523 | A1 * | 9/2011 | Tong et al. | 362/84 |
| 2012/0087105 | A1 * | 4/2012 | Dai et al. | 362/84 |
| 2012/0224363 | A1 * | 9/2012 | Van De Ven | F21K 9/56 362/231 |

(Continued)

FOREIGN PATENT DOCUMENTS

| | | |
|---|---|---|
| CN | 201680288 U | 12/2010 |
| CN | 201892045 U | 7/2011 |

(Continued)

*Primary Examiner* — Peggy Neils

(74) *Attorney, Agent, or Firm* — Muncy, Geissler, Olds & Lowe, P.C.

(57) ABSTRACT

This disclosure discloses an illumination apparatus. The illumination apparatus comprises an inner cover comprising a top surface having a first length; a pedestal on which the inner cover is disposed comprising a top surface having a second length; and a holder supporting the pedestal; wherein the first length is greater than the second length.

15 Claims, 19 Drawing Sheets

(56) References Cited

U.S. PATENT DOCUMENTS

2013/0286632 A1* 10/2013 Edwards ..... 362/84
2013/0308292 A1* 11/2013 Lin ..... C09K 11/00 362/84

FOREIGN PATENT DOCUMENTS

CN 102374418 A 3/2012
GB 2366610 * 3/2002

* cited by examiner

ILLUMINATION APPARATUS

This application is a continuation-in-part of U.S. patent application Ser. No. 13/293,427, entitled "Illumination apparatus", filed on Nov. 10, 2011, and the content of which is hereby incorporated by reference in its entirety.

BACKGROUND

1. Technical Field

The present disclosure relates to an illumination apparatus and in particular to an illumination apparatus with a cover comprising a protrusion.

2. Description of the Related Art

The light-emitting diodes (LEDs) of the solid-state lighting elements have the characteristics of the low power consumption, low heat generation, long operational life, shockproof, small volume, quick response and good opto-electrical property like light emission with a stable wavelength, so the LEDs have been widely used in household appliances, indicator light of instruments, and opto-electrical products, etc. As the opto-electrical technology develops, the solid-state lighting elements have great progress in the light efficiency, operation life and the brightness, and LEDs are expected to become the main stream of the lighting devices in the near future.

Recently, LEDs have been used for general illumination applications. In some applications, there is a need to have a LEDs lamp with an omni-directional light pattern. However, conventional LEDs lamps are not suitable for this need.

In addition, the LEDs can be further connected to other components in order to form a light emitting apparatus. The LEDs may be mounted onto a submount with the side of the substrate, or a solder bump or a glue material may be formed between the submount and the LEDs, therefore a light-emitting apparatus is formed. Besides, the submount further comprises the circuit layout electrically connected to the electrode of the LEDs.

SUMMARY OF THE DISCLOSURE

The present disclosure provides an illumination apparatus.

The illumination apparatus comprises: an inner cover comprising a top surface having a first length; a pedestal on which the inner cover is disposed comprising a top surface having a second length; and a holder supporting the pedestal; wherein the first length is greater than the second length.

BRIEF DESCRIPTION OF THE DRAWINGS

The accompanying drawings are included to provide easy understanding of the application, and are incorporated herein and constitute a part of this specification. The drawings illustrate the embodiments of the application and, together with the description, serve to illustrate the principles of the application.

DETAILED DESCRIPTION OF THE EMBODIMENTS

To better and concisely explain the disclosure, the same name or the same reference number given or appeared in different paragraphs or figures along the specification should has the same or equivalent meanings while it is once defined anywhere of the disclosure.

The following shows the description of the embodiments of the present disclosure in accordance with the drawings.

Figure 1:
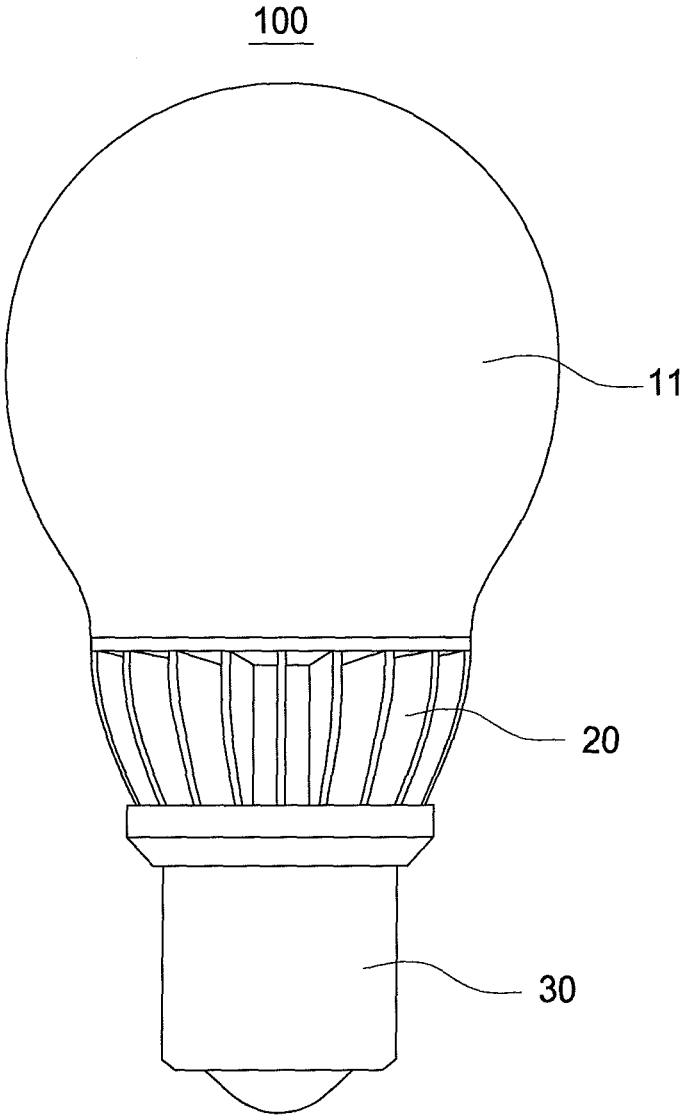
FIG. 1 shows a perspective view of an illumination apparatus in accordance with the first embodiment of the present disclosure.
Figure 2A:
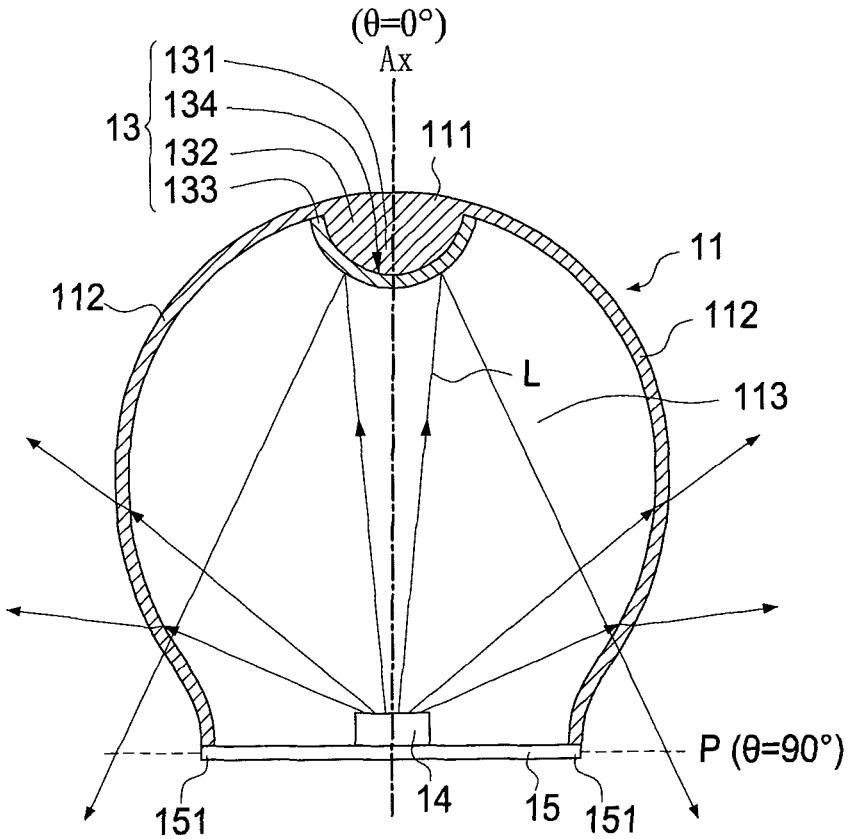
FIG. 2A is a cross-sectional view of a cover of the illumination apparatus in accordance with the first embodiment of the present disclosure.

FIGS. 1 and 2A disclose an illumination apparatus 100 according to the first embodiment of the present disclosure. The illumination apparatus 100 is a lamp bulb. The illumination apparatus 100 comprises a cover 11; a light source 14; a circuit unit 30 electrically connecting with the light source 14 for controlling the light source 14; and a heat sink 20 disposed between the cover 11 and the circuit unit 30 for conducting heat generated by the light source 14 away from the illumination apparatus 100.

Referring to FIG. 2A, the cover 11 comprises a first portion 111 and a second portion 112, and defines a chamber 113 therein. The light source 14 is disposed within the chamber 113. The first portion 111 is arranged in the center of the cover 11, and the second portion 112 surrounds the first portion 111 and symmetrically extends from the first portion 111 in the opposite direction. In one embodiment, the first portion 111 and the second portion 112 comprise the same material. In this embodiment, the first portion 111 of the cover 11 comprises a protrusion 13 extending therefrom and toward the light source 14 such that the first portion 111 has an average thickness greater than that of the second portion 112. In one embodiment, the average thickness of the first portion 111 is at least two times greater than that of the second portion 112. The protrusion 13 of the first portion 111 has a curved surface 134 facing the light source 14 for defining an inner surface and has an area in a plane view larger than that of the light source 14. In this embodiment, the protrusion 13 has a semi-circular shape in cross-section such that the first portion 111 has a non-uniform thickness where a central portion 131 of the first portion 111 is thicker than a peripheral portion 132 of the first portion 111. In contrary, the second portion 112 has a substantially uniform thickness. Since the average thickness of the first portion 111 is greater than that of the second portion 112, the transmittance of the first portion 111 is less than that of the second portion 112, which results in some light emitted from the light source 14 are reflected by the first portion 111. By virtue of the thickness difference between the first and second portions 111, 112, an omni-directional light pattern can be achieved. In one embodiment, less than 80% of the light emitted by the light source 14 is transmitted through the first portion 111, and more than 80% of the light emitted by the light source 14 is transmitted through the second portion 112. In addition, the first and second portions 111, 112 comprise a plurality of diffuser particles dispersed therein, such as $TiO_2$, $SiO_2$, or air. The more the diffuser particles are, the less the transmittance of the first and second portions 111, 112 is.

The illumination apparatus 100 further comprises a holder 15 supporting the light source 14 and having a peripheral 151 connected with the cover 11. The holder 15 is disposed between the cover 11 and the heat sink 20, and the light source 14 is directly disposed on/above the holder 15. In another embodiment, the light source 14 is disposed within the center of the chamber 113 and is supported by the holder 15 through a post (not shown). The holder 15 and the post have heat dissipation properties such that heat generated by the light source 14 can be conducted to the heat sink 20 therethrough. The holder 15 and the post are made of quartz, glass, ZnO, Al, Cu, or Ni.

Figure 2B:
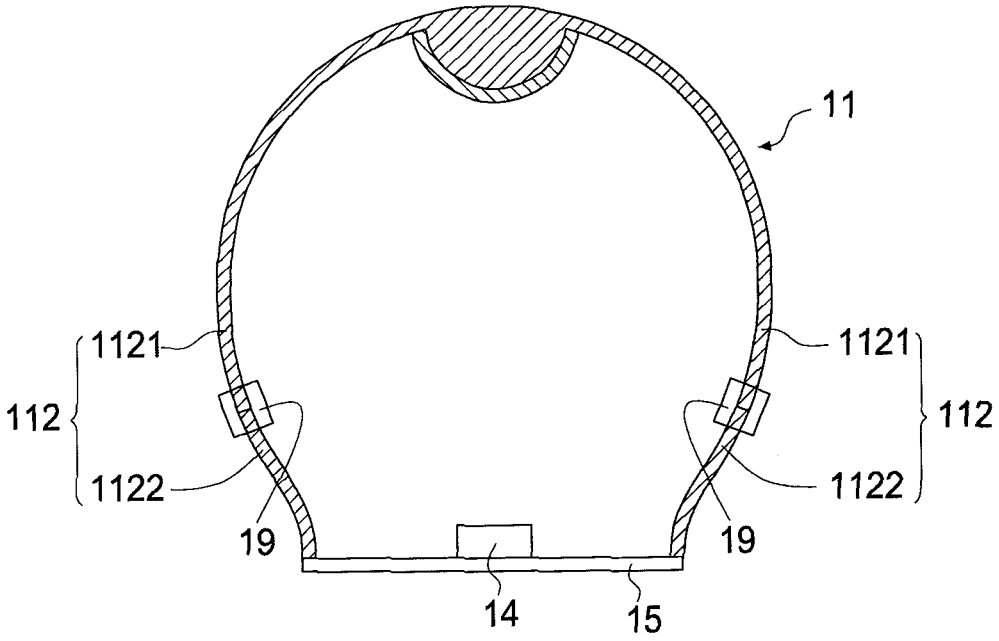
FIG. 2B is a cross-sectional view of the cover of the illumination apparatus in accordance with the first embodiment of the present disclosure, showing a connecting means.

In this embodiment, the protrusion 13 and the cover 11 (the first portion 111 and the second portion 112) comprise the same material and are formed by molding such as injection molding, thereby monolithically integrating with each other to form a single-piece object. The "monolithically integrating" means that there is no boundary existing between the protrusion 13 and the cover 11. It is noted that, as shown in FIG. 2B, the second portion 112 comprises an upper part 1121 extending from the first portion 111 and a lower part 1122 downwardly extending from the upper part 1121. The holder 15 is connected with the lower part 1122. In one embodiment, the upper part 1121 and the lower part 1122 of the second portion 112 are formed as two separate pieces and combined using a connecting means 19 which is arranged close to the holder 15, as shown in FIG. 2B. Alternatively, the connecting means 19 can be arranged in the central position of the cover 11 (not shown). The connecting means 19 comprises screw, fasteners, buckles, or clips. In another embodiment, the upper part 1121 and the lower part 1122 are formed as a one-piece member. The cover 11 comprises glass or polymer, such as polyurethane (PU), polycarbonate (PC), polymethylmethacrylate (PMMA), or polyethylene (PE). The protrusion 13 can be solid or hollow.

Figure 3:
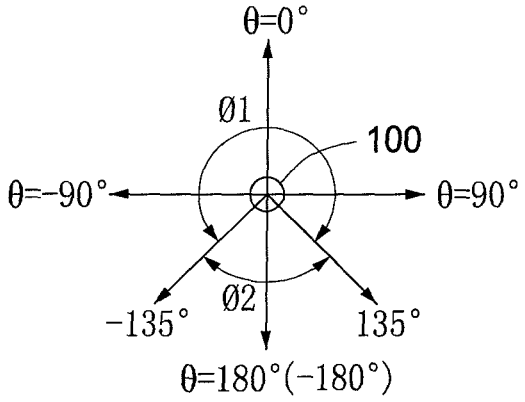
FIG. 3 is a coordinate system to describe the spatial distribution of illumination emitted by the illumination apparatus.

Moreover, referring to FIG. 2A, the protrusion 13 further comprises a reflective coating 133 formed on the inner surface. Therefore, when the light emitted by the light source 14 passes toward different directions as indicated by the arrow L, some of the light passes through the second portion 112 and exits the cover 11, and some of the light emitting toward the protrusion 13 is substantially reflected by the reflective coating 133 and is directed downwardly to exit the cover 11 such that some light exist under the plane (P). The light source 14 has an optical axis (Ax, $\Theta$=0° as shown in FIG. 3). The plane (P, $\Theta$=90° as shown in FIG. 3) is a horizontal plane orthogonal to the optical axis and is coplanar with the holder 15 on which the light source 14 is disposed. Specifically, as shown in FIG. 3, a coordinate system is used to describe the spatial distribution of the illumination emitted by the light source 14 or the illumination apparatus 100. A direction of the illumination is described by a coordinate $\Theta$ in a range [0°, 180°]. By virtue of the protrusion 13 comprising the reflective coating 133 formed thereon or by virtue of the thickness difference between the first and second portions 111, 112, the direction of the illumination emitted by the illumination apparatus 100 is in a range from 135° to −135° ($\Psi_1$=270°) for achieving an omni-directional light pattern. It is noted that "omni-directional light pattern" means more than 5% of the light emitted by the light source 14 is existing in the range from −135° to 135°($\Psi_2$=90°). The "substantially reflected" means more than 90% of the light emitted by the light source 14 is reflected by the reflective coating 133 and less than 10% of the light emitted by the light source 14 is transmitted through the first portion 111. In one embodiment, the reflective coating 133 can be formed on an outer surface opposite to the inner surface. The reflective coating 133 comprises paint with silver or aluminum. Alternatively, the reflective coating 133 can be a reflective layer (not shown) including a plurality of sub-layers formed as a Distributed Bragg Reflector (DBR). In another embodiment, the protrusion 13 comprises a rough surface, such as a nanostructure for scattering the light.

Figure 4A:
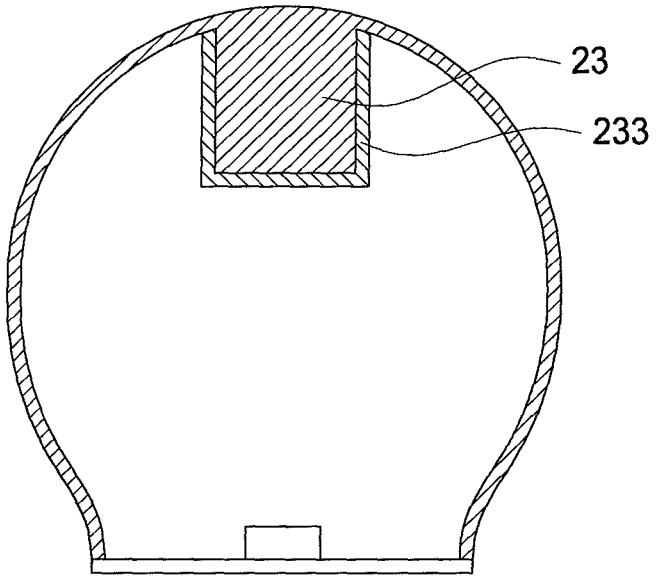
FIGS. 4A to 4F shows covers with various shapes.
Figure 4B:
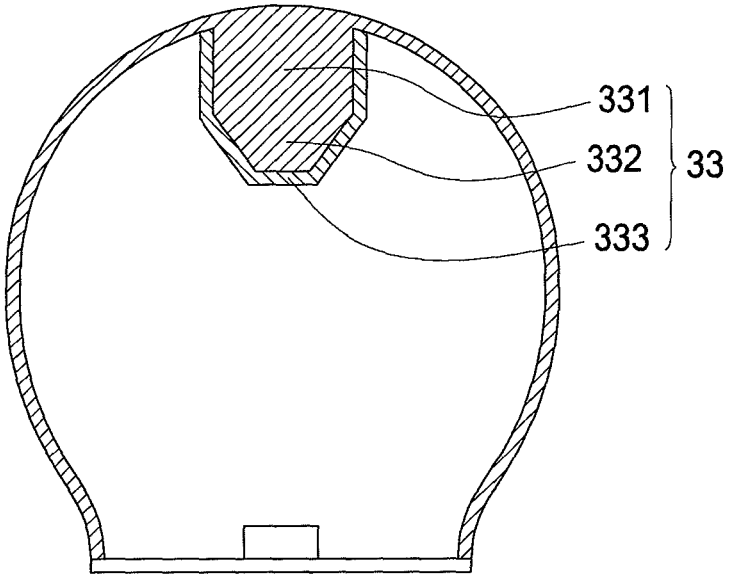
Figure 4C:
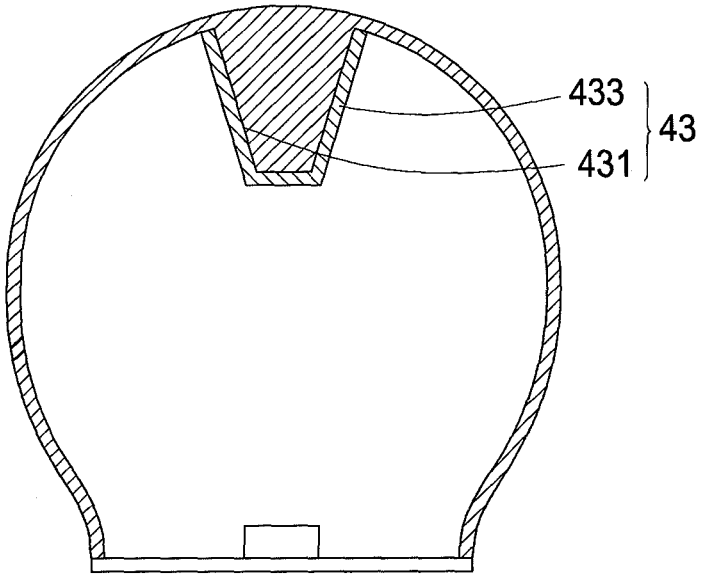
Figure 4D:
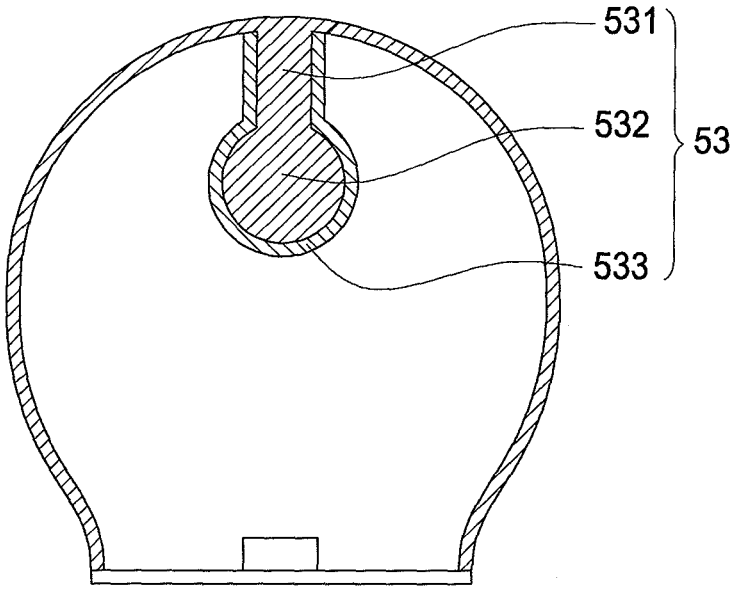
Figure 4E:
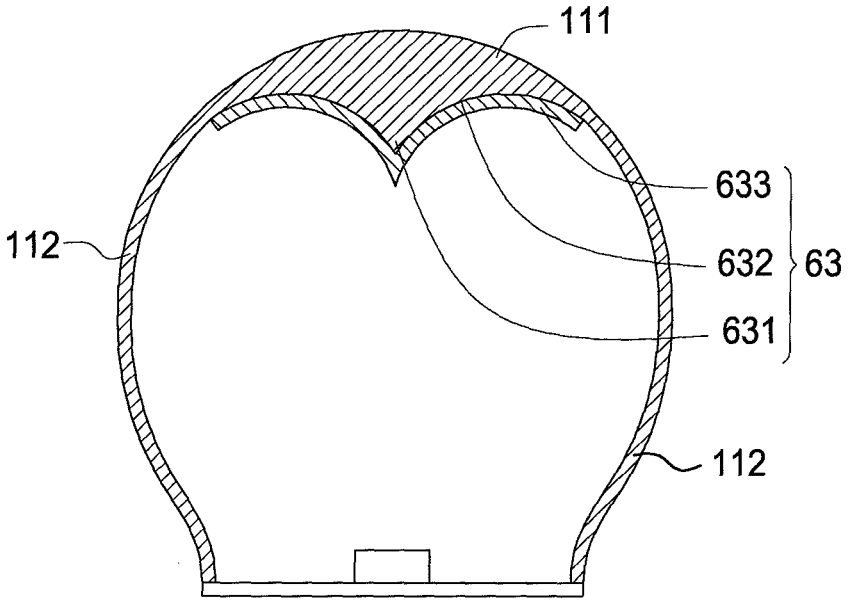
Figure 4F:
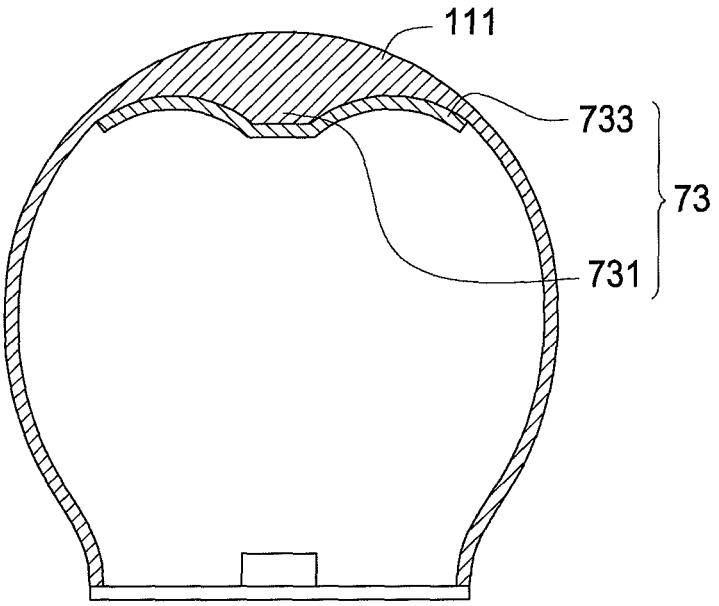

FIGS. 4A to 4F disclose the cover with various shapes. Referring to FIG. 4A, the protrusion 23 has a rectangular shape in cross-section and comprises the reflective coating 233 formed thereon. Referring to FIG. 4B, the protrusion 33 comprises a first section 331 having a rectangular shape in cross-section, and a second section 332 extending from the first section 331 toward the light source and having a truncated shape in cross-section. In addition, the reflective coating 333 is formed on the first and second sections 331, 332 of the protrusion 33. Referring to FIG. 4C, the protrusion 43 comprises two inclined sidewalls 431 and has a trapezoidal shape in cross-section. The protrusion 43 further comprises the reflective coating 433 formed thereon. Referring to FIG. 4D, the protrusion 53 comprises a first part 531 having a rectangular shape in cross-section, and a second part 532 extending from the first part 531 toward the light source and having a circular shape in cross-section. Likewise, the protrusion 53 further comprises the reflective coating 533 formed thereon. Referring to FIG. 4E, the protrusion 63 comprises a tip 631 corresponding to the center of the first portion 111, and two curved surface 632 divergently extending from the tip 631. The protrusion 63 further comprises the reflective coating 633 formed thereon. Referring to FIG. 4F, the protrusion 73 has a similar structure to that in FIG. 4E, except that the protrusion 73 has a flat surface 731 corresponding to the center of the first portion 111. The protrusion 73 further comprises the reflective coating 733 formed thereon.

Figure 5:
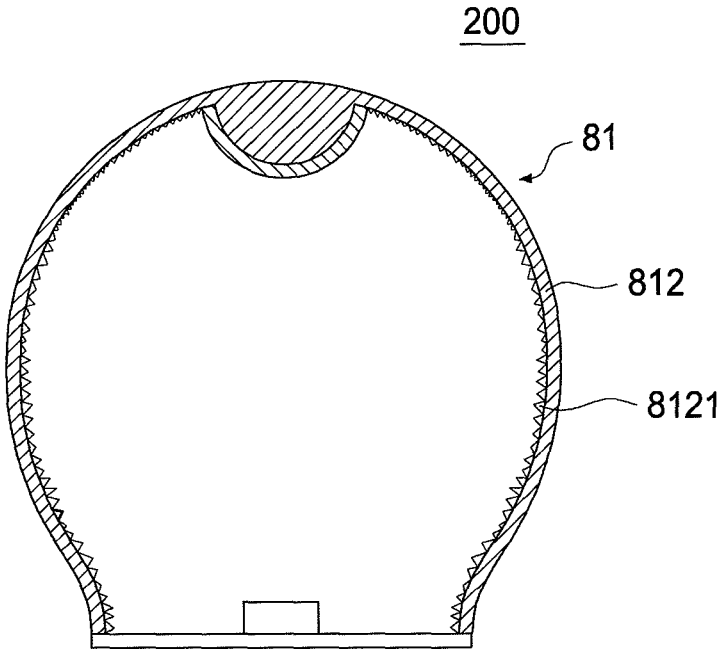
FIG. 5 is a cross-sectional view of the cover of the illumination apparatus in accordance with the second embodiment of the present disclosure.

FIG. 5 discloses a cover of an illumination apparatus 200 according to the second embodiment of the present disclosure. The second embodiment of the illumination apparatus 200 has the similar structure with the first embodiment of the illumination apparatus 100. In this embodiment, the second portion 812 of the cover 81 comprises a rough surface 8121, such as a nanostructure for scattering the light. It is noted that the rough surface 8121 can be provided in portions of the second portion 812.

Figure 6:
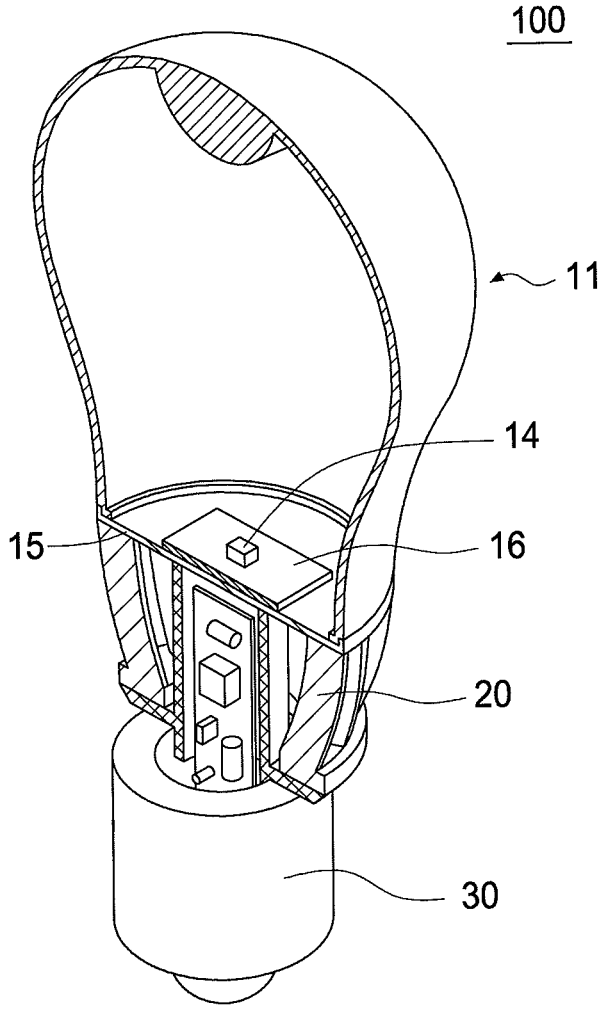
FIG. 6 is a schematic cross-sectional view of the illumination apparatus in accordance with the first embodiment of the present disclosure.
Figure 7:
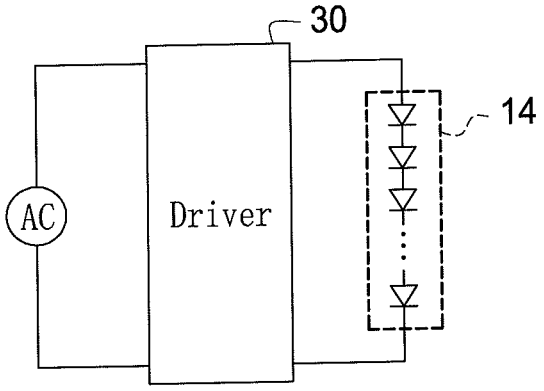
FIG. 7 is a circuit diagram of the illumination apparatus in accordance with the first embodiment of the present disclosure.

FIG. 6 discloses a perspective view of the illumination apparatus 100 as shown in FIG. 1. The light source 14 is electrically connected with a board 16, such as PCB board, which is disposed on the holder 15. FIG. 7 shows a circuit diagram of the circuit unit 30. The circuit unit 30 comprises a bridge rectifier (not shown) electrically connected with a power source which provides an alternating current signal for receiving and regulating the alternating current signal into a direct current signal. In this embodiment, the light source 14 comprises a plurality of light-emitting diodes connected in series with each other. Alternatively, the light-emitting diodes can be connected in parallel or series-parallel with each other. The light source 14 can comprise the light-emitting diodes with the same wavelength. In one embodiment, the light source 14 comprises the light-emitting diodes with different wavelengths such as red, green and blue light-emitting diodes for color mixing, or a wavelength converter formed on the light-emitting diodes for generating a converted light having a wavelength different from the wavelength of the light emitting from the light source 14. In one embodiment, the light source 14 can be a point light source, a planar light source, or a linear light source which comprises a plurality of light-emitting diodes arrange in a line.

Figure 8A:
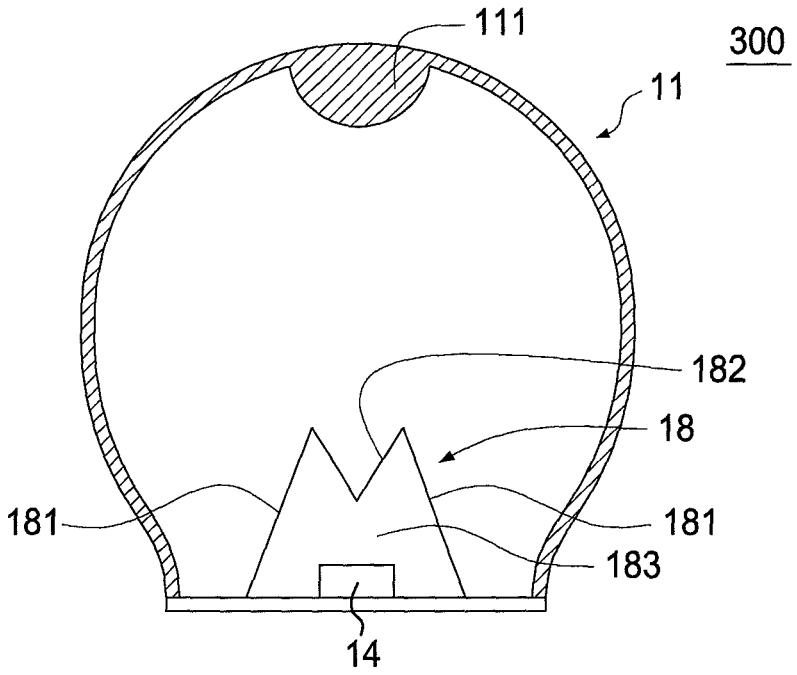
FIG. 8A is a cross-sectional view of the cover of the illumination apparatus in accordance with the third embodiment of the present disclosure.

FIG. 8A discloses a cover of an illumination apparatus 300 according to the third embodiment of the present disclosure. The third embodiment of the illumination apparatus 300 has the similar structure with the first embodiment of the illumination apparatus 100. The illumination apparatus 300 further comprises an inner cover 18 which is disposed in the chamber 113 and which is formed above and enclosing the light source 14. The inner cover 18 defines an inner chamber 183 therein and the light source 14 is disposed within the inner chamber 183. In this embodiment, the inner cover 18 comprises two slanted sidewalls 181, and a concave portion 182 extending between the sidewalls 181 and monolithically integrating with the slanted sidewalls 181. The concave portion 182 has a triangular shape in cross-section. In this embodiment, more than 80% of the light emitted by the light source 14 is transmitted through the inner cover 18 toward the protrusion 13 of the cover 11 and is reflected by the protrusion 13, thereby achieving the omni-directional light pattern. In addition, the first portion 111 has an area larger than that of the inner cover 18 in a plan view. The inner cover 18 is hollow and spaced apart from the light source 14. The inner cover 18 is made of polymer such as polymethylmethacrylate (PMMA), polycarbonate (PC), polyurethane (PU), or polyethylene (PE), or oxide such as quartz, glass, or ZnO. In one embodiment, the slanted sidewall 181 has a plurality of ZnO nanowire formed thereon for improving heat radiation.

Figure 8B:
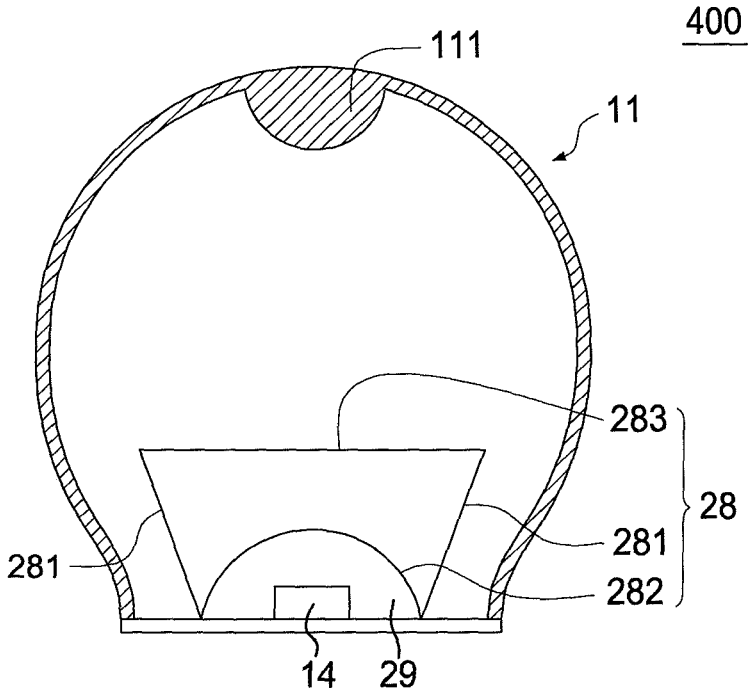
FIG. 8B is a cross-sectional view of the cover of the illumination apparatus in accordance with the fourth embodiment of the present disclosure.

FIG. 8B discloses a cover of an illumination apparatus 400 according to the fourth embodiment of the present disclosure. The fourth embodiment of the illumination apparatus 400 has the similar structure with the third embodiment of the illumination apparatus 300. The inner cover 28 comprises a convex portion 282, a plat surface 283 opposite to the convex portion 282, and two slanted sidewalls 281 extending between the convex portion 282 and the flat surface 283. The inner cover 28 is solid and there is an air gap 29 formed between the inner cover 28 and the light source 14. Alternatively, an adiabatic material having a heat conductivity lower than a heat conductivity of epoxy or 0.2 W/m*K is filled between the inner cover 28 and the light source 14. The adiabatic material comprises nano-silica or nano-composite. In one embodiment, a wavelength converter (not shown) is formed on the flat surface 283 or/and the two slanted sidewalls 281.

Figure 8C:
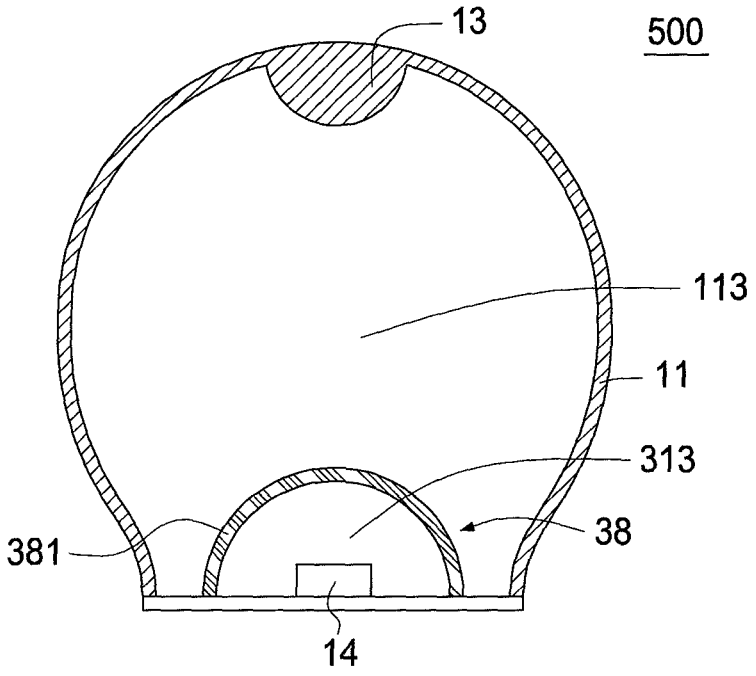
FIG. 8C is a cross-sectional view of the cover of the illumination apparatus in accordance with the fifth embodiment of the present disclosure.

FIG. 8C discloses a cover of an illumination apparatus 500 according to the fifth embodiment of the present disclosure. The fifth embodiment of the illumination apparatus 500 has the similar structure with the third embodiment of the illumination apparatus 300. The inner cover 38 is disposed in the chamber 113 and above the light source 14. The inner cover 38 defines an inner chamber 313 therein and the light source 14 is disposed within the inner chamber 313. The cover 11 and the inner cover 38 comprise a plurality of diffuser particles (not shown) therein. The more the diffuser particles are, the less the transmittance is. Accordingly, the concentrations of the diffuser particles within the cover 11 and the inner cover 38 are adjustable to be different for achieving the omni-directional light pattern. The diffuser particles comprise $TiO_2$, $SiO_2$, or air. In this embodiment, the inner cover 38 further comprises a wavelength converter 381 formed on an outer surface thereof facing the protrusion 13 for generating a converted light having a wavelength different from the wavelength of the light emitting from the light source 14. In one embodiment, the inner chamber 313 comprises an adiabatic material having a heat conductivity lower than a heat conductivity of glass or 0.8 W/m*K, or preferably lower than a heat conductivity of epoxy or 0.2 W/m*K for preventing the heat generated by the wavelength converter 381 from being conducted back to the light source 14 and therefore decreasing the luminous efficiency of the light source 14. The adiabatic material comprises nano-silica or nano-composite.

Figure 8D:
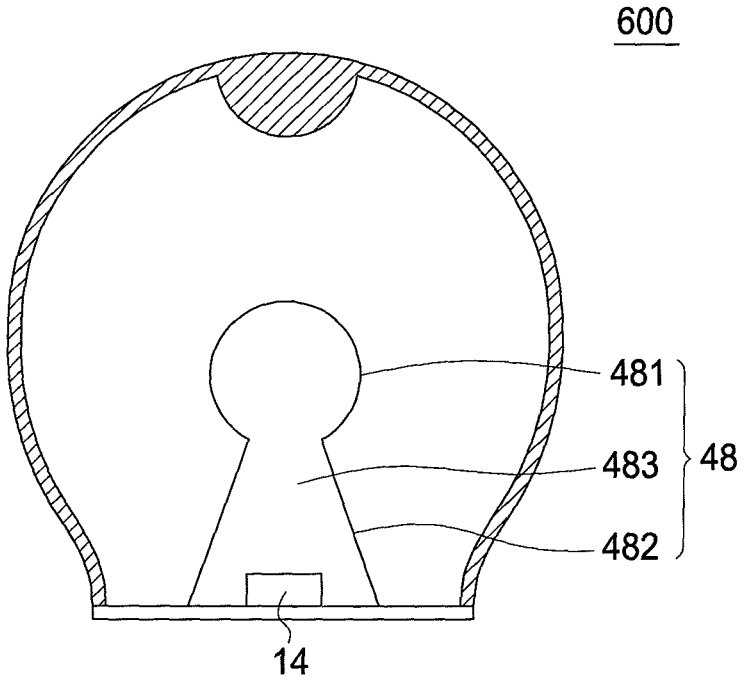
FIG. 8D is a cross-sectional view of the cover of the illumination apparatus in accordance with the sixth embodiment of the present disclosure.

FIG. 8D discloses a cover of an illumination apparatus 600 according to the sixth embodiment of the present disclosure. The sixth embodiment of the illumination apparatus 600 has the similar structure with the third embodiment of the illumination apparatus 300. The inner cover 48 comprises a first portion 481 having a sphere-like shape in cross-section and a second portion 482. The inner cover 48 is hollow and defines an inner chamber 483 therein. The light source 14 is disposed within the inner chamber 483. The second portion 482 is made of Ag or Al for reflecting the light emitted from the light source 14. Alternatively, the second portion 482 comprises a reflective coating such as Ag or Al formed thereon.

Figure 9A:
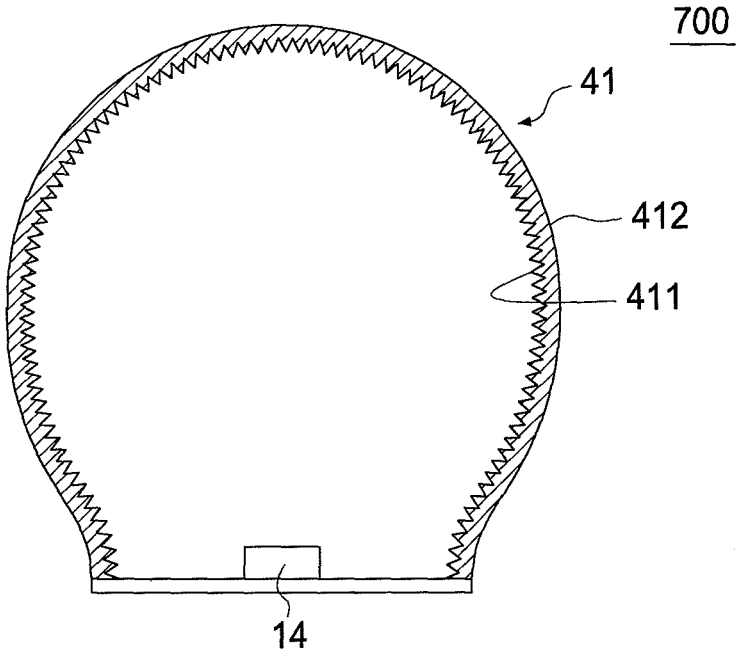
FIG. 9A is a cross-sectional view of the cover of the illumination apparatus in accordance with the seventh embodiment of the present disclosure.
Figure 9B:
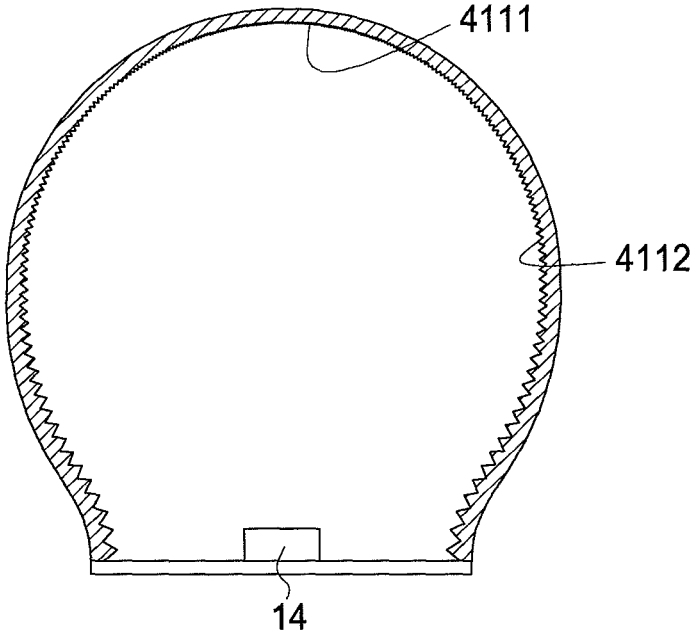
FIG. 9B is a cross-sectional view of the cover of the illumination apparatus in accordance with the seventh embodiment, showing different roughness density.

FIG. 9A discloses a cover of an illumination apparatus 700 according to the seventh embodiment of the present disclosure. The cover 41 comprises a rough structure formed on the inner surface 411, and a smooth outer surface 412 opposite to the inner surface 411. The cover 41 comprises plastic such as polymethylmethacrylate (PMMA), polycarbonate (PC), polyurethane (PU), polyethylene (PE), or glass. In this embodiment, the rough structure is formed by sand blasting, injection molding, polishing, or wet etching using an etchant such as acetone, ethyl acetate, or monomethyl ether acetate. In this embodiment, the rough structure has a uniform roughness density on the entire inner surface 411. Alternatively, as shown in FIG. 9B, the roughness density is different on the inner surface 411, that is, the rough structure comprising a gradient in the roughness density from a central part 4111 to a peripheral part 4112 of the cover 41. Due to the difference of the roughness density, the light emitted from the light source 14 is scattered more at the central part 4111 than that at the peripheral part 4112. The roughness density is defined by a haze (H) value. The definition of haze is a ratio of scattering light (S) to the total light (scattering light (S)+transmitted light (T)). The haze value of the central part 4111 ranges from 0.5 to 0.9. The haze value of the peripheral part 4112 ranges from 0.3 to 0.6.

Figure 10A:
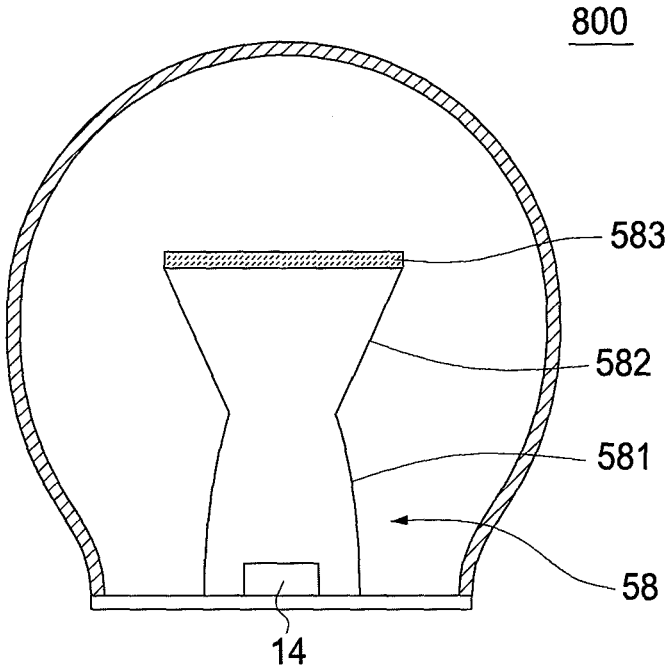
FIG. 10A is a cross-sectional view of the cover of the illumination apparatus in accordance with the eighth embodiment of the present disclosure.

FIG. 10A discloses a cover of an illumination apparatus 800 according to the eighth embodiment of the present disclosure. The eighth embodiment of the illumination apparatus 800 has the similar structure with the sixth embodiment of the illumination apparatus 600. The inner cover 58 comprises a first light-guiding portion 581, and a second light-guiding portion 582. The first light-guiding portion 581 has a barrel-like shape in cross-section for efficiently guiding the light emitting from the light source 14 toward the second light-guiding portion 582. The inner cover 58 further comprises a wavelength converter 583 formed on the second light-guiding portion 582 for generating a converted light having a wavelength different from the wavelength of the light emitting from the light source 14. The second light-guiding portion 582 has a trapezoidal shape in cross-section for reflecting the light from the first light-guiding portion 581 toward the wavelength converter 583. When the light emitted from the light source 14 through the first and second light-guiding portions 581, 582 toward the wavelength converter 583, the light is converted and scattered by particles dispersed in the wavelength converter 583 such that the light is upwardly and downwardly transmitted through the first and second light-guiding portions 581, 582, and further transmitted through the cover 11 so as to achieve the omni-directional light pattern. In this embodiment, the first light-guiding portion 581 and the second light-guiding portion 582 comprise the same material, such as PMMA, PC, silicon, or glass. In one embodiment, the inner cover 58 comprises an adiabatic material having a heat conductivity lower than a heat conductivity of glass or 0.8 W/m*K, or preferably lower than a heat conductivity of epoxy or 0.2 W/m*K for preventing the heat generated by the wavelength converter 583 from being conducted back to the light source 14 and therefore decreasing the luminous efficiency of the light source 14. The adiabatic material comprises nano-silica or nano-composite.

Figure 10B:
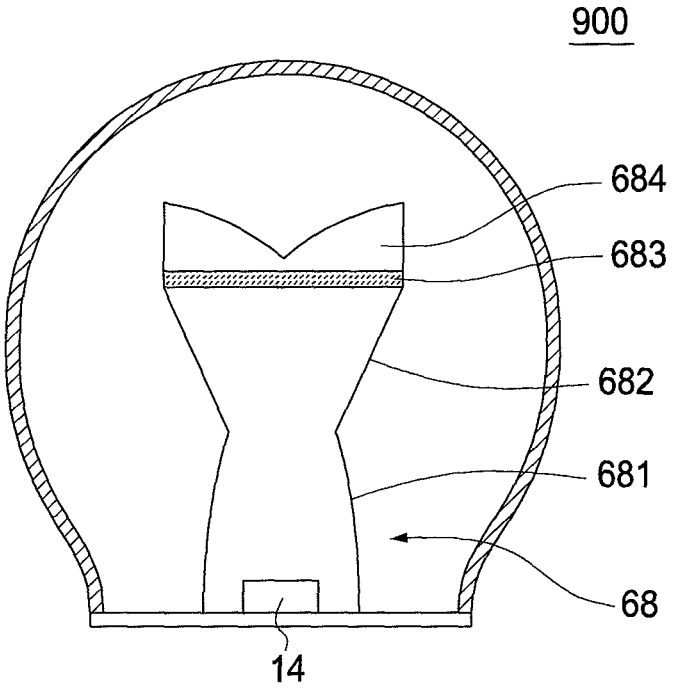
FIG. 10B is a cross-sectional view of the cover of the illumination apparatus in accordance with the ninth embodiment of the present disclosure.

FIG. 10B discloses a cover of an illumination apparatus 900 according to the ninth embodiment of the present disclosure. The ninth embodiment of the illumination apparatus 900 has the similar structure with the eighth embodiment of the illumination apparatus 800. The inner cover 68 further comprises a third light-guiding portion 684 formed on the wavelength converter 683 such that the wavelength converter 683 is sandwiched between the second light-guiding portion 682 and the third light-guiding portion 684. The third light-guiding portion 684 comprises two curved surfaces for reflecting the light toward a lateral direction. The first, second, and third light-guiding portions 681, 682, and 684 can be solid or hollow.

Figure 10C:
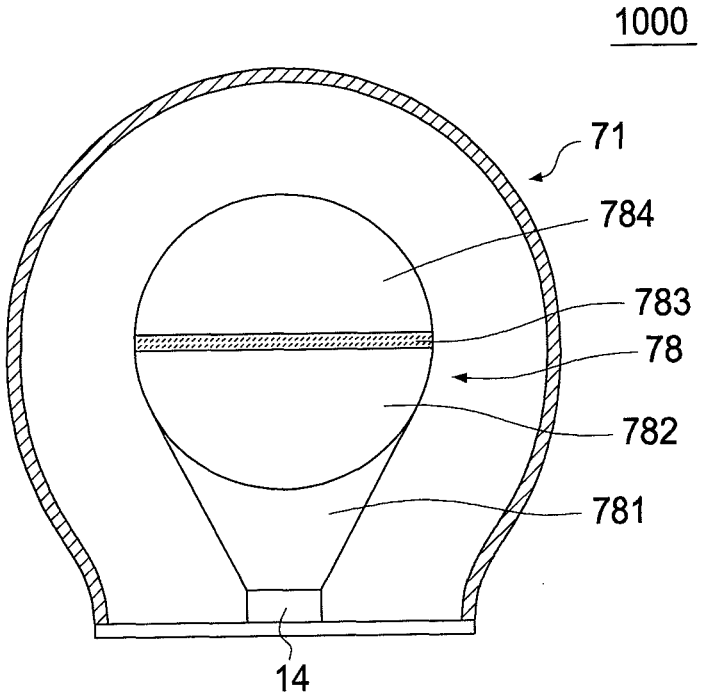
FIG. 10C is a cross-sectional view of the cover of the illumination apparatus in accordance with the tenth embodiment of the present disclosure.

FIG. 10C discloses a cover of an illumination apparatus 1000 according to the tenth embodiment of the present disclosure. The tenth embodiment of the illumination apparatus 1000 has the similar structure with the ninth embodiment of the illumination apparatus 900 and comprises the first, second, and third light-guiding portions 781, 782, 784. The first light-guiding portion 781 has a trapezoidal-like shape in cross-section for guiding the light toward the second light-guiding portion 782. Each of the second and third light-guiding portions 782, 784 has a semi-circular shape in cross-section. The wavelength converter 783 is sandwiched between the second light-guiding portion 782 and the third light-guiding portion 784. Due to the shape of the second and third light-guiding portions 782, 784, a total reflection occurred at the interface between the light-guiding portions 782, 784 and air can be reduced. Likewise, when the light emitted from the light source 14 through the first and second light-guiding portions 781, 782 toward the wavelength converter 783, the light is converted and scattered by particles dispersed in the wavelength converter 883 such that the light is upwardly and downwardly transmitted through the cover so as to achieve the omni-directional light pattern. In one embodiment, the first and second light-guiding portions 781, 782 comprise an adiabatic material having a heat conductivity lower than a heat conductivity of glass or 0.8 W/m*K, or preferably lower than a heat conductivity of epoxy or 0.2 W/m*K for preventing the heat generated by the wavelength converter 783 from being conducted back to the light source 14 and therefore decreasing the luminous efficiency of the light source 14. The adiabatic material comprises nano-silica or nano-composite.

Figure 10D:
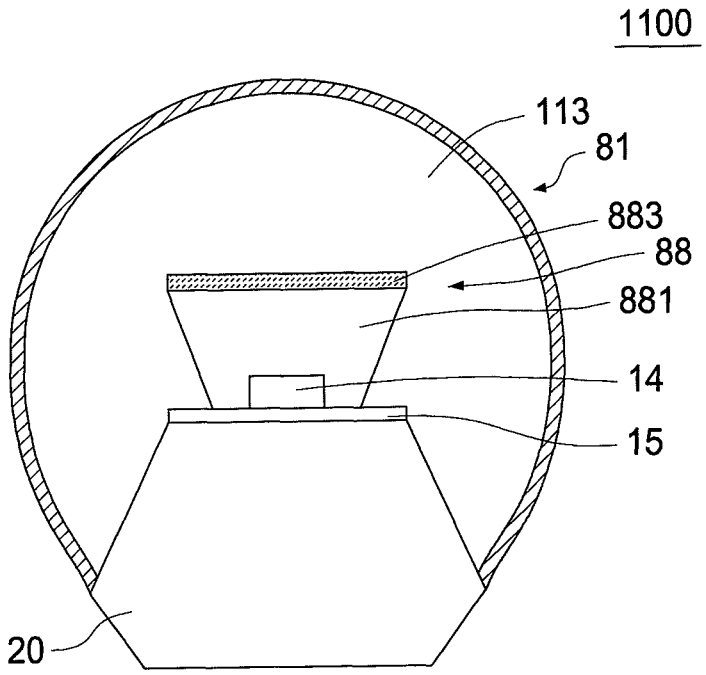
FIG. 10D is a cross-sectional view of the cover of the illumination apparatus in accordance with the eleventh embodiment of the present disclosure.

FIG. 10D discloses a cover of an illumination apparatus 1100 according to the eleventh embodiment of the present disclosure. The heat sink 20 extends into the chamber 113 of the cover 81, and the light source 14 is disposed in the center of the chamber 113. The inner cover 88 is formed above the light source 14 and comprises a light-guiding portion 881 and a wavelength converter 883 formed on the light-guiding portion 881. Because of the position of the light source 14 (in the center of the chamber 113), when the light emitted from the light source 14 toward the wavelength converter 883, the light is scattered by particles dispersed in the wavelength converter 883 such that light is upwardly and downwardly transmitted through the cover 81 so as to achieve the omni-directional light pattern. In one embodiment, the light-guiding portion 881 comprises an adiabatic material having a heat conductivity lower than a heat conductivity of glass or 0.8 W/m*K, or preferably lower than a heat conductivity of epoxy or 0.2 W/m*K for preventing the heat generated by the wavelength converter 883 from being conducted back to the light source 14 and therefore decreasing the luminous efficiency of the light source 14. The adiabatic material comprises nano-silica or nano-composite.

Figure 11:
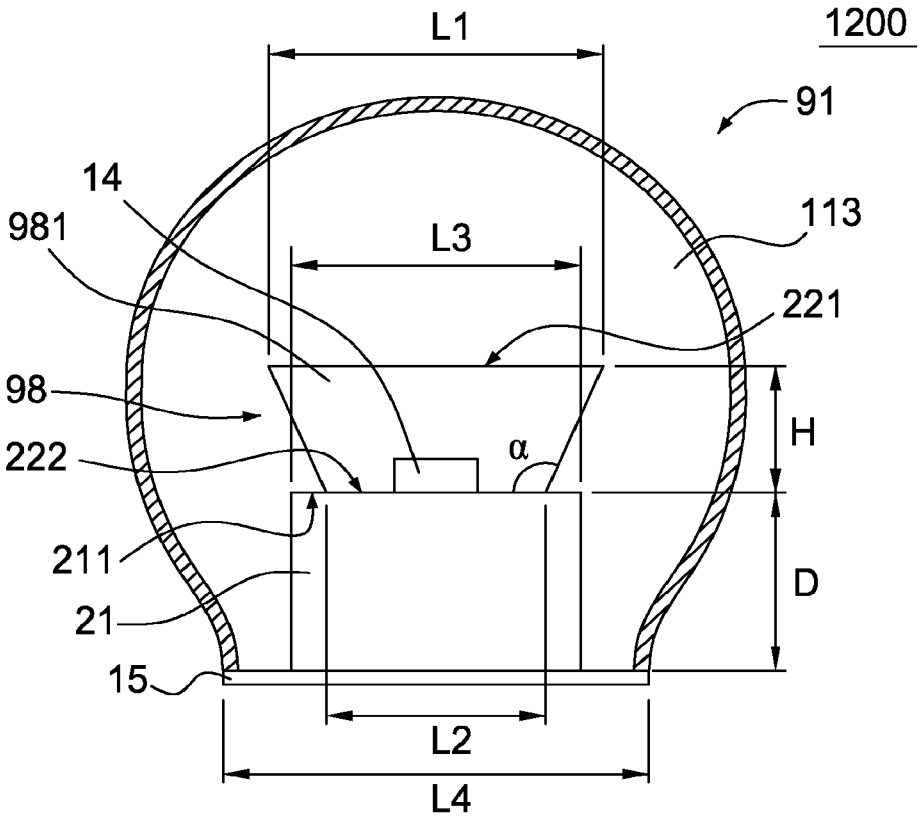
FIG. 11 is a cross-sectional view of the inner cover.
Figure 12A:
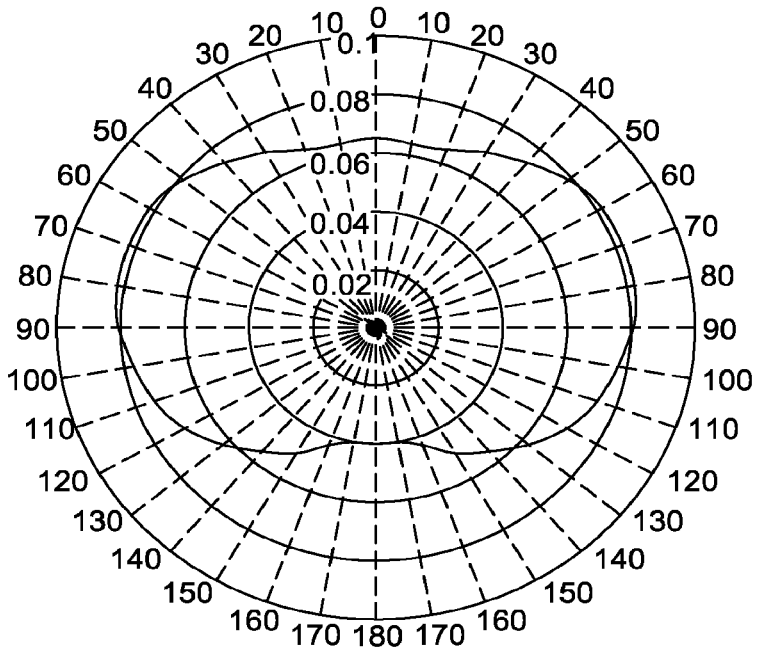
FIGS. 12A to 12E show simulated luminous intensity distributions at different distances (D).
Figure 12B:
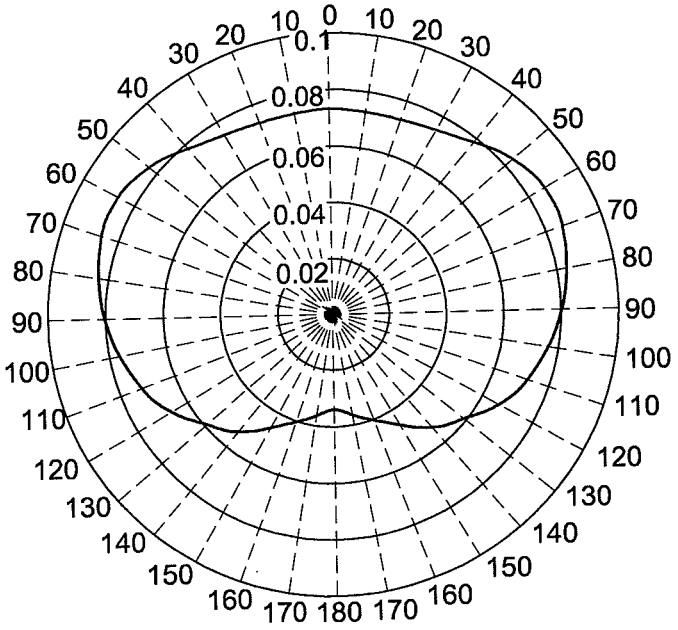
Figure 12C:
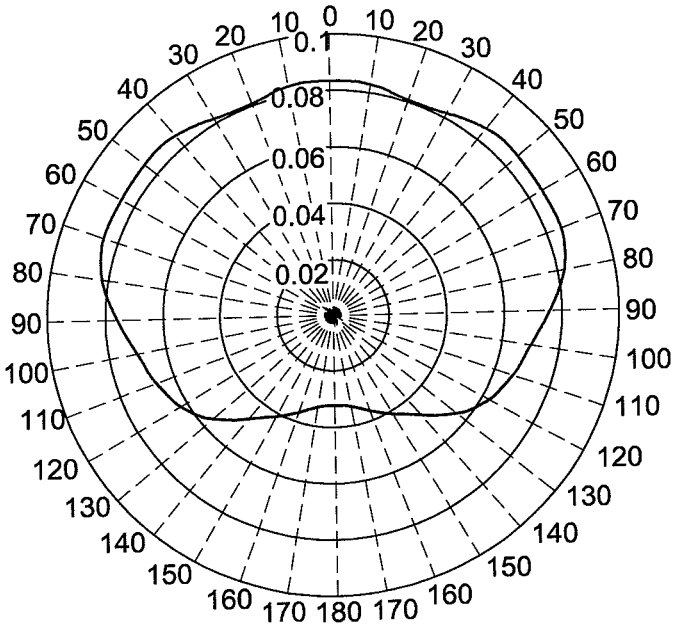
Figure 12D:
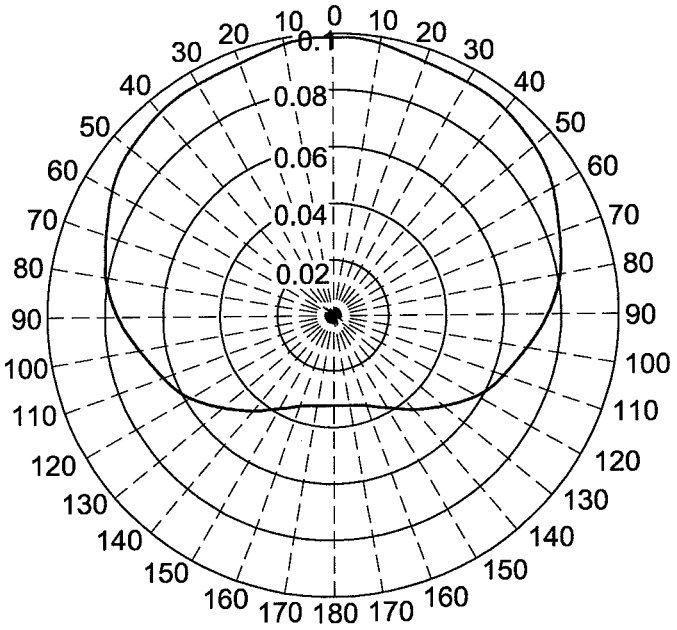
Figure 12E:
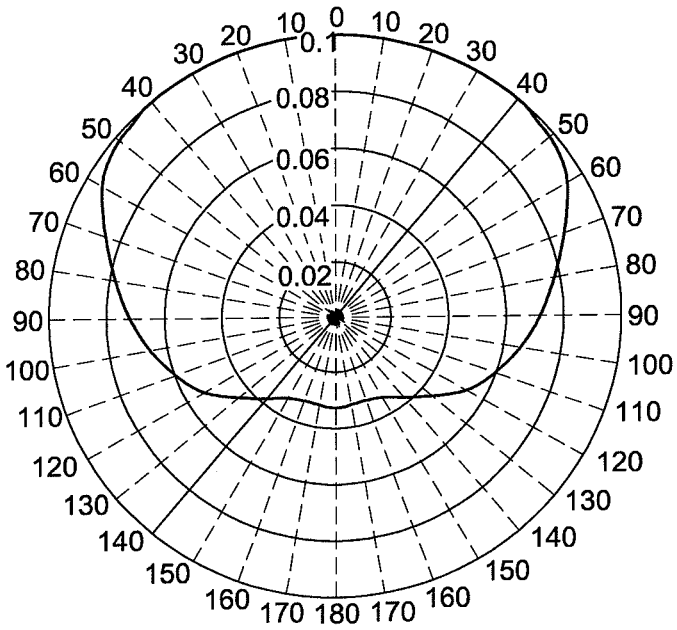

FIG. 11 discloses an illumination apparatus 1200 according to the twelfth embodiment of the present disclosure. Referring to FIG. 11, the illumination apparatus 1200 includes a pedestal 21. The inner cover 98 has a trapezoidal shape including a top surface 221 having a first length (L1), a bottom surface having a second length (L2), and a height (H). In this embodiment, the pedestal 21 extends into the chamber 113 of the cover 91 and the light source 14 is disposed on the pedestal 21. In other words, the pedestal 21 and the light source 14 are all arranged within the chamber 113 of the cover 91. The chamber 113 can be optionally filled with material which is transparent or translucent to light from the light source 14 and helpful to lower the temperature inside the cover 91, especially the temperature of the light source 14. Specifically, the material filled with the cover 91 can be the fluid or solid that has low electrical conductivity and high transparency. For example, the fluid includes water, ethanol, methanol, or oil.

The pedestal 21 can be preferably made by one or more thermally conductive materials for transmitting heat generated by the light source 14 to the heat sink 20 (as shown in FIG. 1). The thermally conductive material can be a ceramic material, a polymer, or a metal. The metal includes but not limited to Cu, Al, Ni, and Fe, The heat sink 20 and the pedestal 21 can be constructed by the same material(s). Moreover, the pedestal 21 has a top surface 211 having a third length (L3) and the holder 15 has a fourth length (L4). The ratio of the first length (L1) to the second length (L2) is greater than 2. The ratio of the height (H) to the second length (L2) ranges between 1 and 1.5 The height (H) is in a range of 3-9 mm. The bottom surface is inclined with respect to the height at an angle ($\alpha$) ranging from 106° to 132.5°. In one embodiment, the first, second, third, and fourth lengths have relationships L4>L1>L3 and L4>L1>L2. The third length can be greater, equal to or smaller than the second length. When the first length (L1) is greater than the second and third lengths (L2, L3), light emitted from the light source 14 through the sidewall 981 does not be blocked by the pedestal 21, thereby achieving the omni-directional light pattern. FIGS. 12A to 12E show simulated luminous intensity distributions at different distances (D) from the light source 14 to the holder 15, as shown in FIG. 11. The distances (D) shown in FIGS. 11A to 11E are 0 cm, 5 cm, 10 cm, 15 cm, and 20 cm, respectively. When the distance (D) is larger, the light intensity in the direction in a range between 0° to 90° is greater.

Figure 13A:
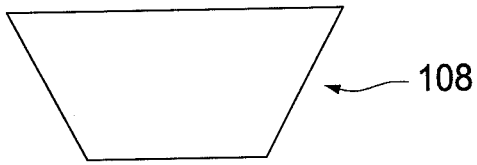
FIGS. 13A to 13C show different shapes of the inner cover.
Figure 13B:
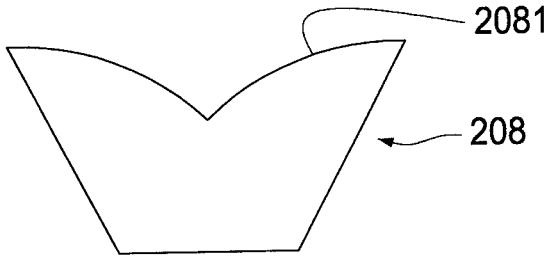
Figure 13C:
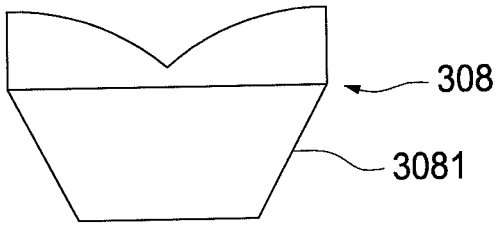
Figure 14A:
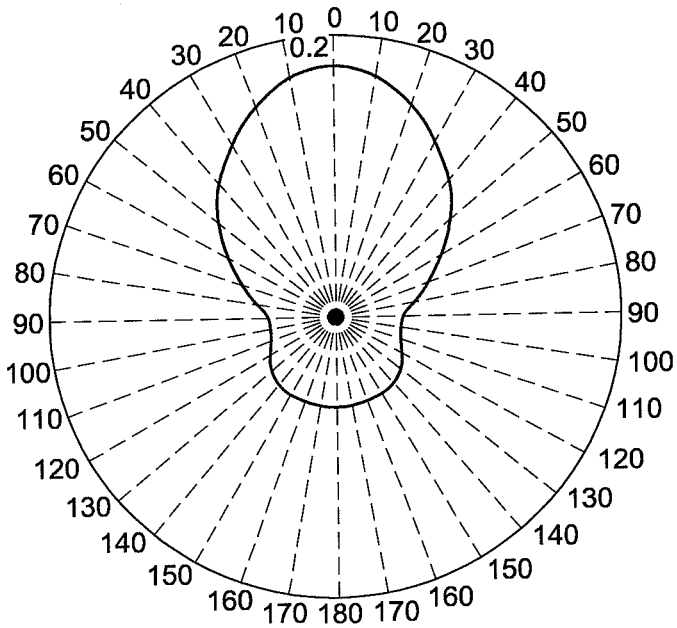
FIGS. 14A to 14C are simulated luminous intensity distributions.
Figure 14B:
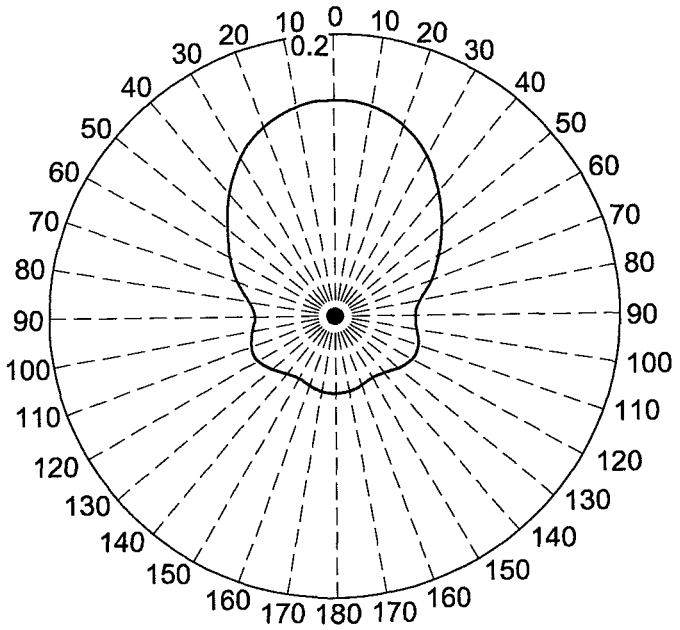
Figure 14C:
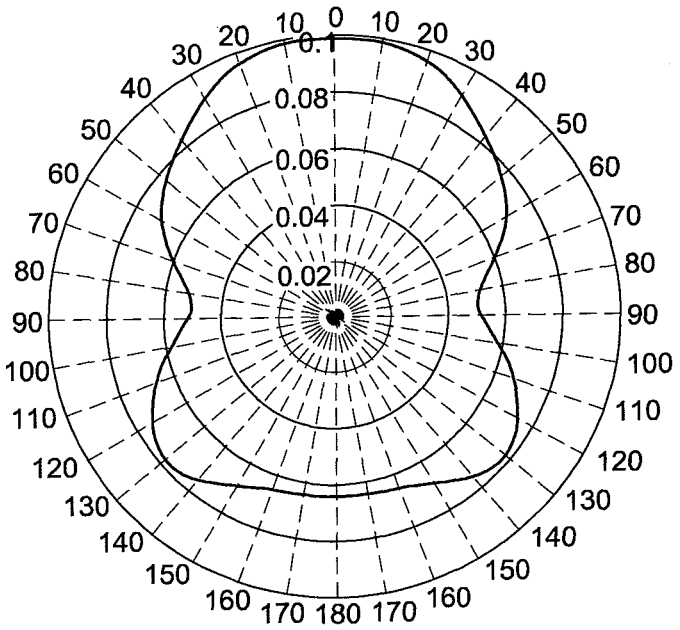

FIGS. 13A to 13C show different shapes of the inner cover. FIGS. 14A to 14C show simulated luminous intensity distributions when the inner cover has different shapes as shown in FIGS. 13A to 13C, respectively. When the inner cover 208 as shown in FIG. 13B comprises a cavity having two curved surfaces 2081, the light intensity in the direction in a range between 110° and 130° is greater than the inner cover 108 shown in FIG. 13A. Moreover, when the inner cover 308 further comprises a light-guiding portion 3081, the light intensity in all directions is greater than the inner cover 108 shown in FIG. 13A, for achieving the omni-directional light pattern.

Figure 15A:
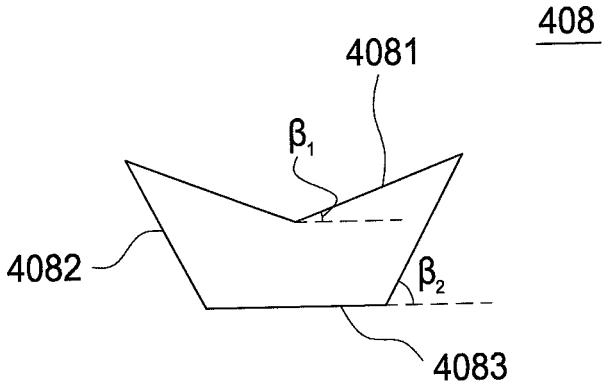
FIGS. 15A to 15E show different shapes of the inner cover.
Figure 15B:
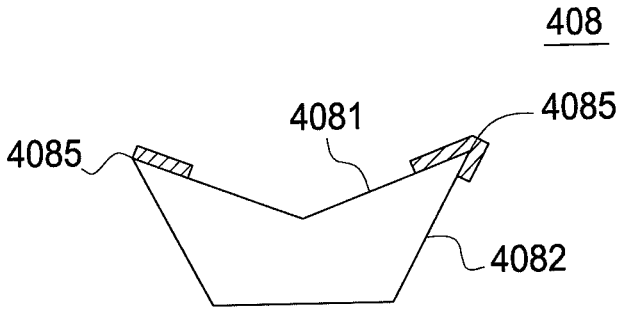
Figure 15C:
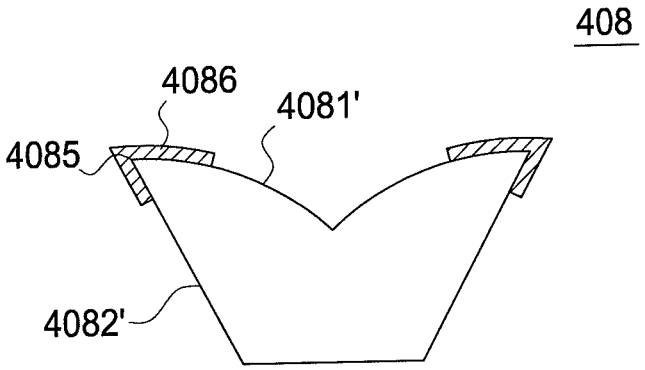
Figure 15D:
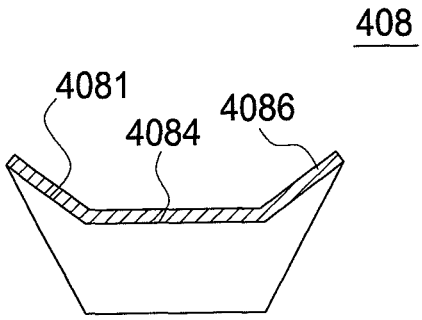
Figure 15E:
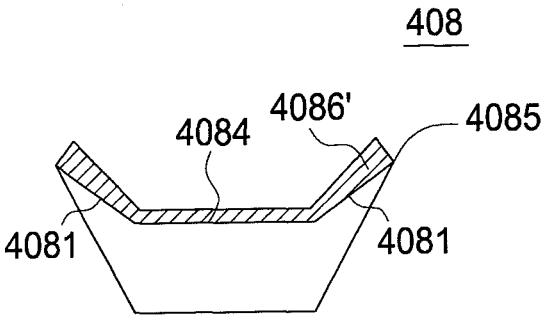

In another embodiment, FIG. 15A shows a cross-sectional view of an inner cover 408 which is similar to the inner cover 208 shown in FIG. 13B. The top surface of the inner cover 408 has two surface regions 4081, two sidewalls 4082 and a bottom surface 4083. The surface region 4081 is inclined with respect to the bottom surface 4083 at an angle ($\beta$1) ranging between 20° and 40° and the sidewall 4082 is inclined with respect to the bottom surface 4083 at an angle ($\beta$2) ranging between 30° and 60°. As shown in FIG. 15B, the surface regions 4081 and the sidewalls 4082 are formed in straight lines and joined at a point for forming an apex 4085. The inner cover 408 can optionally be covered by a wavelength converter 4086 formed on a portion of the surface regions 4081 and/or a portion of the sidewall 4082 for entirely covering the apex 4085. As shown in FIG. 15C, the surface regions 4081' and the sidewalls 4082' are curved and joined for forming a curved surface 4085' and the wavelength converter 4086 is formed to entirely cover the curved surface 4085'. As shown in FIG. 15D, the top surface of the inner cover 408 has two inclined surface regions 4081 and a flat region 4084 between the two inclined surface regions 4081. A wavelength converter 4086 is entirely formed on the two inclined surface regions 4081 and the flat region 4084 with a uniform thickness. As shown in FIG. 15E, the wavelength converter 4086' has a graded thickness in a direction from the apex 4085 to the flat region 4084. In one embodiment, the thickness of the wavelength converter 4086' close to the apex 4085 is thicker than that close to the flat region 4084 for obtaining a uniform color temperature.

It will be apparent to those having ordinary skill in the art that various modifications and variations can be made to the devices in accordance with the present disclosure without departing from the scope or spirit of the disclosure. In view of the foregoing, it is intended that the present disclosure covers modifications and variations of this disclosure provided they fall within the scope of the following claims and their equivalents.

What is claimed is:

1. An illumination apparatus comprising:

an inner cover comprising a first top surface wherein the top surface comprises two inclined surface regions inclined with respect to the bottom surface at an angle ranging from 20° to 40°; a bottom surface, and a first side surface;

an outer cover covering the first top surface and the first side surface;

a light-emitting source entirely covered by the inner cover and the outer cover in at least one direction;

a pedestal arranged beneath the inner cover and comprising a second top surface being parallel to the bottom surface;

a holder supporting the pedestal; wherein the inner cover has a width substantially larger than that of the pedestal; and a wavelength converter formed on a portion of the two inclined surface regions.

2. The illumination apparatus of claim 1, wherein the holder has a length greater than that of the inner cover.

3. The illumination apparatus of claim 1, wherein the pedestal comprises a second side surface covered by the outer cover.

4. The illumination apparatus of claim 1, wherein the light source is not directly connected to the inner cover.

5. The illumination apparatus of claim 4, further comprising a heat sink connected to the holder for conducting heat generated by the light source away from the illumination apparatus.

6. The illumination apparatus of claim 5, wherein the pedestal and the heat sink comprise a material in common.

7. The illumination apparatus of claim 6, wherein the material is selected from the group consisting of ceramic material, polymer, and metal.

8. The illumination apparatus of claim 1, wherein the first side surface is inclined with respect to the bottom surface at an angle ranging from 30° to 40°.

9. The illumination apparatus of claim 1, wherein a first inclined surface region comprises a curved portion.

10. The illumination apparatus of claim 1, wherein a first inclined surface region is totally flat.

11. The illumination apparatus of claim 1, wherein the wavelength converter has a non-uniform thickness.

12. The illumination apparatus of claim 1, wherein the wavelength converter has a center portion and an outer portion thicker than the center portion.

13. The illumination apparatus of claim 1, wherein the wavelength converter is directly formed on the top surface and having a non-uniform thickness.

14. The illumination apparatus of claim 1, wherein a first inclined surface region is connected to the first side surface in an apex.

15. The illumination apparatus of claim 14, wherein the apex is covered by the wavelength converter.

* * * * *